US006644996B2

(12) United States Patent
Yamashita

(10) Patent No.: US 6,644,996 B2
(45) Date of Patent: Nov. 11, 2003

(54) CONNECTOR

(75) Inventor: Kazunori Yamashita, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/132,126

(22) Filed: Apr. 24, 2002

(65) Prior Publication Data

US 2003/0049959 A1 Mar. 13, 2003

(30) Foreign Application Priority Data

Aug. 9, 2001 (JP) ..... 2001-242584

(51) Int. Cl.[7] ..... H01R 13/9627
(52) U.S. Cl. ..... 439/352; 439/489
(58) Field of Search ..... 439/352, 489, 439/353, 354, 357

(56) References Cited

U.S. PATENT DOCUMENTS 5,820,399 A * 10/1998 Shirouza et al. ..... 439/352
6,102,726 A * 8/2000 Tsuji et al. ..... 439/352
6,109,956 A * 8/2000 Kawase et al. ..... 439/489
6,231,368 B1 * 5/2001 Murakami et al. ..... 439/352
6,241,547 B1 * 6/2001 Fukuda ..... 439/352
6,280,237 B1 8/2001 Saka et al.
6,386,898 B1 5/2002 Taguchi

* cited by examiner

*Primary Examiner*—Ross Gushi
(74) *Attorney, Agent, or Firm*—Gerald E. Hespos; Anthony J. Casella

(57) ABSTRACT

When a connecting or separating operation with or from a mating connector M is interrupted, contact portions 35 of a slider 30 push a receptacle Ma by being subjected to biasing forces accumulated in biasing springs 25, thereby forcibly separating a housing 10 from the mating connector F. This forcible separation shows that two connectors were left partly connected. Since a pair of left and right biasing springs 25 and a pair of left and right contact portions 35 are provided at the opposite sides of a lock arm 17 along the upper surface of the housing 10, a width of the housing 10 is smaller as compared to a connector in which the biasing springs and the contact portions are provided on the left and right side surfaces of the housing.

6 Claims, 12 Drawing Sheets

CONNECTOR

BACKGROUND OF THE INVENTION

1. Field of the Invention

The invention relates to a connector with a partial connection detecting function.

2. Description of the Related Art

A connector with a partial connection detecting function is disclosed in U.S. Pat. No. 6,280,237. This connector has a housing that is connectable with and separable from a forwardly projecting receptacle of a mating connector. The connector has a slider that is movable forward and back parallel to connecting and separating directions of the connectors, and springs that bias the slider forward. The slider is held in contact with the receptacle of the mating connector while the connector is being fitted into the receptacle. Thus, the slider moves back and biasing forces accumulate in the springs. The biasing forces of the springs push the slider forward if a connecting operation is interrupted with the connectors only partly connected. Thus, the slider pushes the receptacle back to separate the connectors. Two properly connected connectors are separated by first moving the slider back. If a separating operation is interrupted, the biasing forces of the springs push the slider forward and thus push the receptacle back to separate the connectors. In other words, the connectors are separated forcibly if the connecting or separating operation is interrupted. This forcible separation shows that the connectors are left partly connected.

Left and right springs and left and right contacts of the slider with the receptacle extend along the left and right side walls of the housing in the above-described connector. Hence, there is a problem of a wide housing.

In view of the above situation, an object of the present invention is to provide an improved operability and preferably to reduce a width of a housing.

SUMMARY OF THE INVENTION

The invention is directed to a connector that is connectable with and separable from a mating connector. The mating connector has a forwardly projecting receptacle and a receiving portion on the receptacle. The connector comprises a housing that is fittable into the receptacle. A lock arm is formed on the housing for engaging the receiving portion of the mating connector to hold a properly connected state of the connectors. A slider is provided in the housing and is movable substantially parallel to the connecting and separating directions of the connectors. Biasing means are provided for biasing the slider forward or toward the mating connector. The slider is configured to contact the receptacle and is moved back while accumulating biasing forces in the biasing means at intermediate stages of the connection and separation of the connectors. The biasing means preferably comprises left and right springs, and left and right contacts of the slider with the receptacle preferably are at substantially opposite sides of the lock arm.

A connecting operation with the mating connector may be interrupted. In this case, the biasing means urges the slider forward, and the slider pushes the receptacle for forcibly separating the housing from the mating connector. A separating operation from the mating connector also may be interrupted. Again, the biasing means urges the slider forward and the slider pushes the receptacle for forcibly separating the housing from the mating connector. Thus, the housing never fails to be separated forcibly from the mating housing when the connector is partly connected with the mating connector. This forcible separation shows that the two connectors were left partly connected.

Left and right the biasing springs and left and right contacts of the slider with the receptacle are at the opposite sides of the lock arm along the upper surface of the housing. Thus, the width of the housing is small as compared to a connector having the biasing springs and the contacts of the slider with the receptacle on the left and right side surfaces of the housing.

The slider may be inclinable with respect to the housing and may have a restrictable portion that contacts a backward movement restricting portion of the housing during the connection of the connector with the mating connector. Thus, the slider is inclined to disengage the contact from the receptacle as connection proceeds further. Additionally, the contact is disengaged from the receptacle when the properly connected state of the connectors is reached, and the slider is moved forward by the biasing forces of the biasing means, while causing the contact to slide over the upper surface of the receptacle.

The slider is disengaged from the receptacle and moved forward when the connectors are connected properly. Thus, the biasing forces accumulated in the biasing springs are released, and the biasing springs do not experience a resilient strain even if the connectors are connected for a long time.

The slider preferably has a pushing portion and the lock arm preferably has a pushable portion. The pushing portion and the pushable portion contact each other while the slider moves forward with the connectors properly connected and with the lock arm displaced from the receiving portion. The slider pushes the lock arm to engage the receiving portion while being moved forward by the contact of the pushing portion and pushable portion. More particularly, the slider is moved forward even if the lock arm is left disengaged from the receiving portion with the connectors properly connected. Thus, locking by the lock arm and the receiving portion securely functions.

The slider preferably is inclinable between a lock permitting posture and an unlocking posture. The slider in the lock permitting posture permits the engagement of the lock arm with the receiving portion. However, the slider in the unlocking posture displaces the lock arm in a direction to be disengaged from the receiving portion when the slider is at a moved-back position. The contact portion of the slider preferably contacts the receptacle and the biasing forces accumulated in the springs are given to the receptacle via the slider when the slider is inclined to the unlocking posture.

The slider may be inclined to the unlocking posture. In this case, locking by the lock arm and the receiving portion is canceled, and it is possible to separate the connector from the mating connector. Simultaneously, the contact of the slider contacts the receptacle to give the biasing forces of the springs to the receptacle, thereby enabling a partial connection detection. As a result, separation from the mating connector and partial connection detection both can be prepared merely by making one action of inclining the slider. Therefore, operability during the separating operation is good.

The slider preferably is held laterally by a box formed on the connector and/or wherein the slider engages lateral surfaces of the lock arm.

The slider preferably can be horizontal, with one or more contacts at a height to contact a front end of the receptacle when the slider is in its horizontal position.

Most preferably, an end of the slider projects into a notch in the housing when the slider is in an inclined position.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
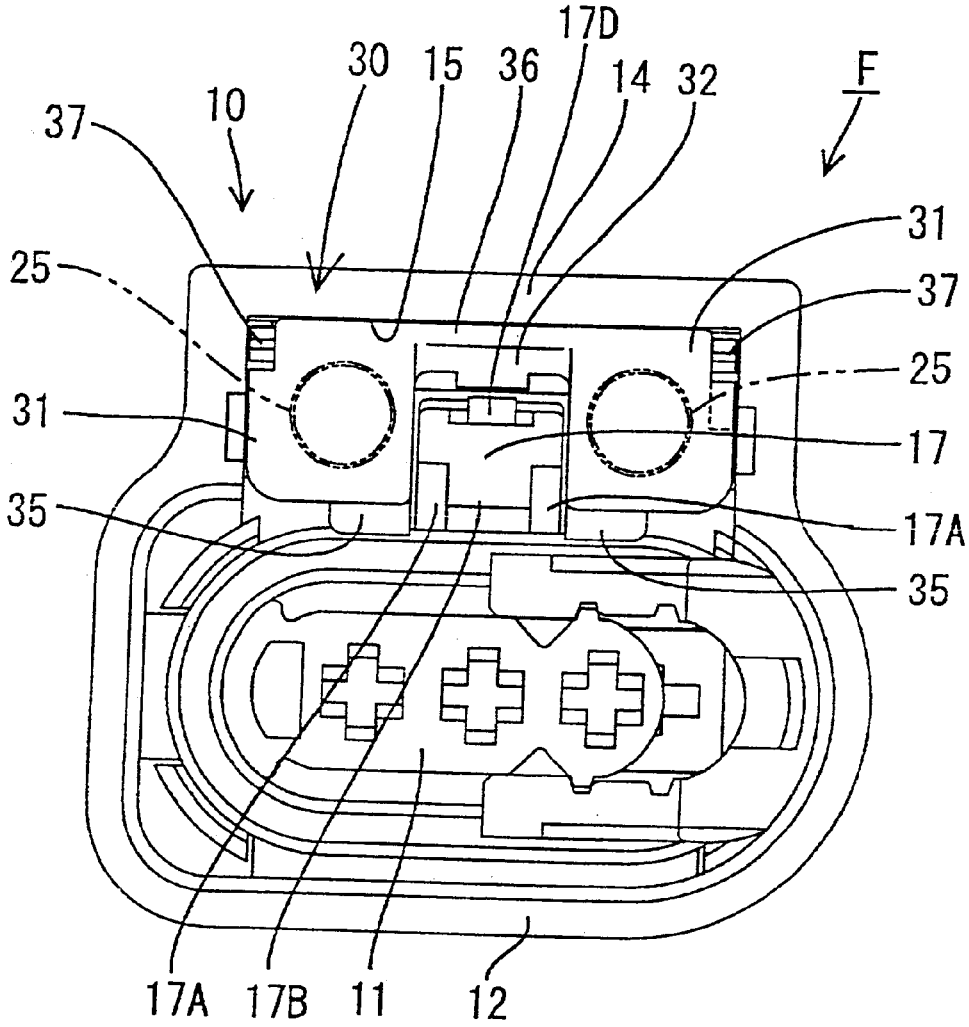
FIG. 1 is a front view of a connector according to one embodiment.
Figure 2:
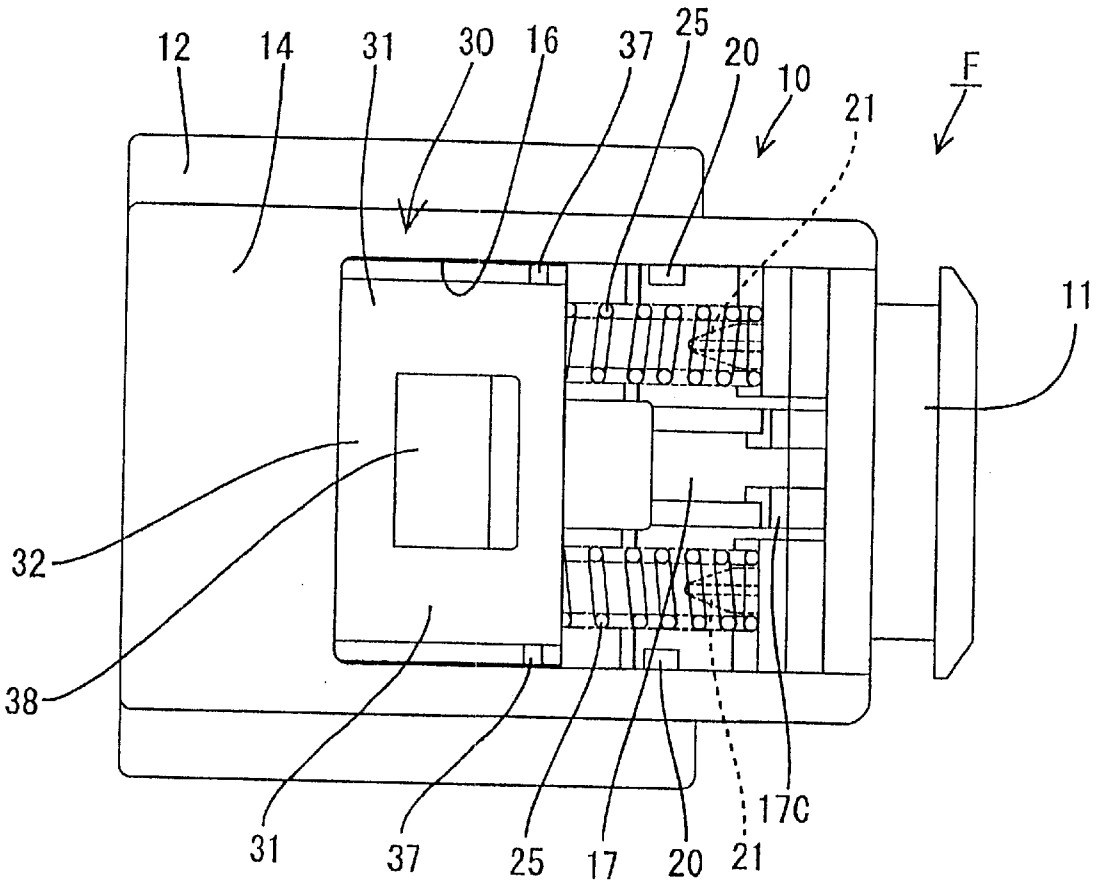
FIG. 2 is a plan view of the connector.
Figure 3:
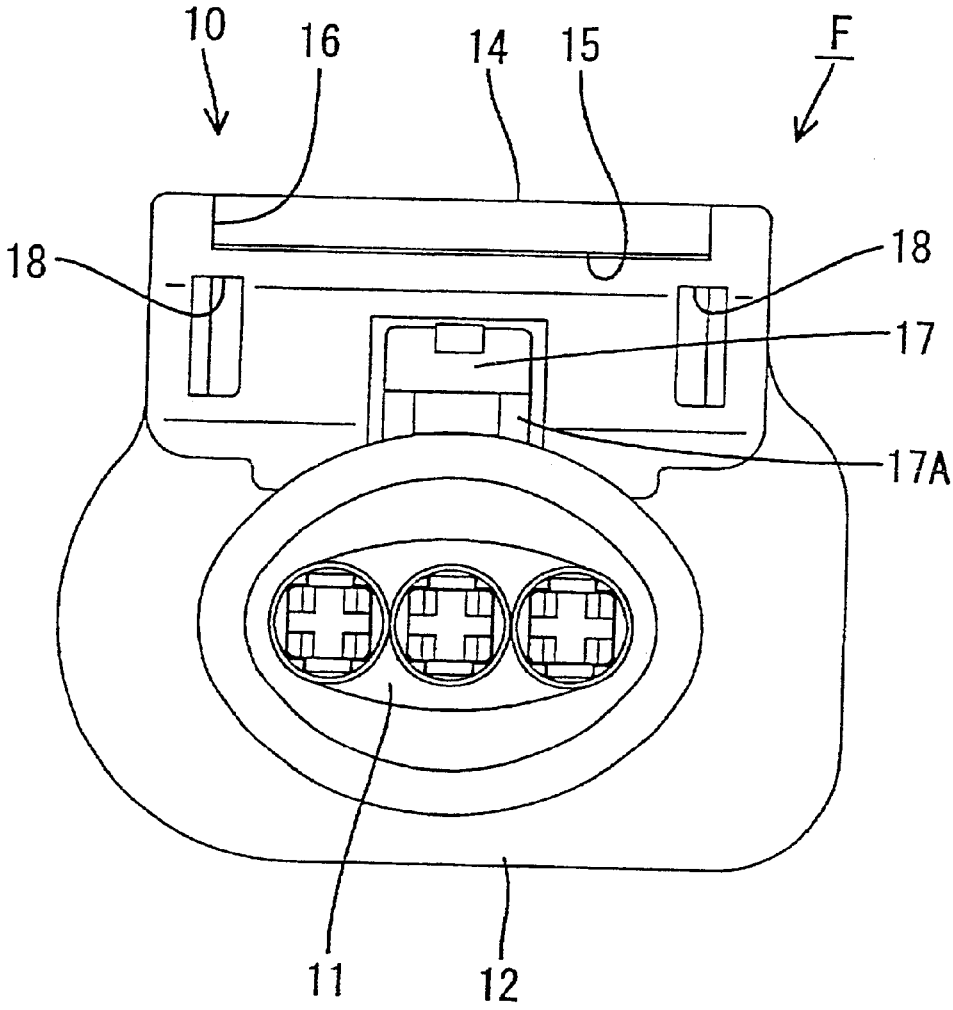
FIG. 3 is a rear view of the connector.

The letter F in FIGS. 1–12 identifies a connector according to the invention. The connector F is connectable to a mating connector M that has a forwardly projecting receptacle Ma. Male terminal fittings Mb project into the receptacle Ma, and a protuberance Mc is formed on the outer surface of the receptacle Ma for locking.

The connector F is comprised of a housing 10, a slider 30 and biasing springs 25. The housing 10 is formed e.g. of a synthetic resin, and includes a housing main body 11 and a substantially tubular fitting 12. The housing main body 11 is configured to fit into the receptacle Ma and the tubular fitting 12 is configured to fit on the receptacle Ma. Female terminal fittings 13 are accommodated in the housing main body 11. A substantially rectangular box 14 bulges up from a portion of the tubular fitting 12 that corresponds to the upper surface of the housing main body 11. The inside of the box 14 defines an operation space 15 that faces the upper surface of the housing main body 11. A notch 16 is formed in a rear part of the upper wall of the box 14 preferably over more than half, and most preferably over about ⅔ of a dimension of the upper wall along forward and backward directions. The notch 16 exposes the operation space 15.

Figure 12:
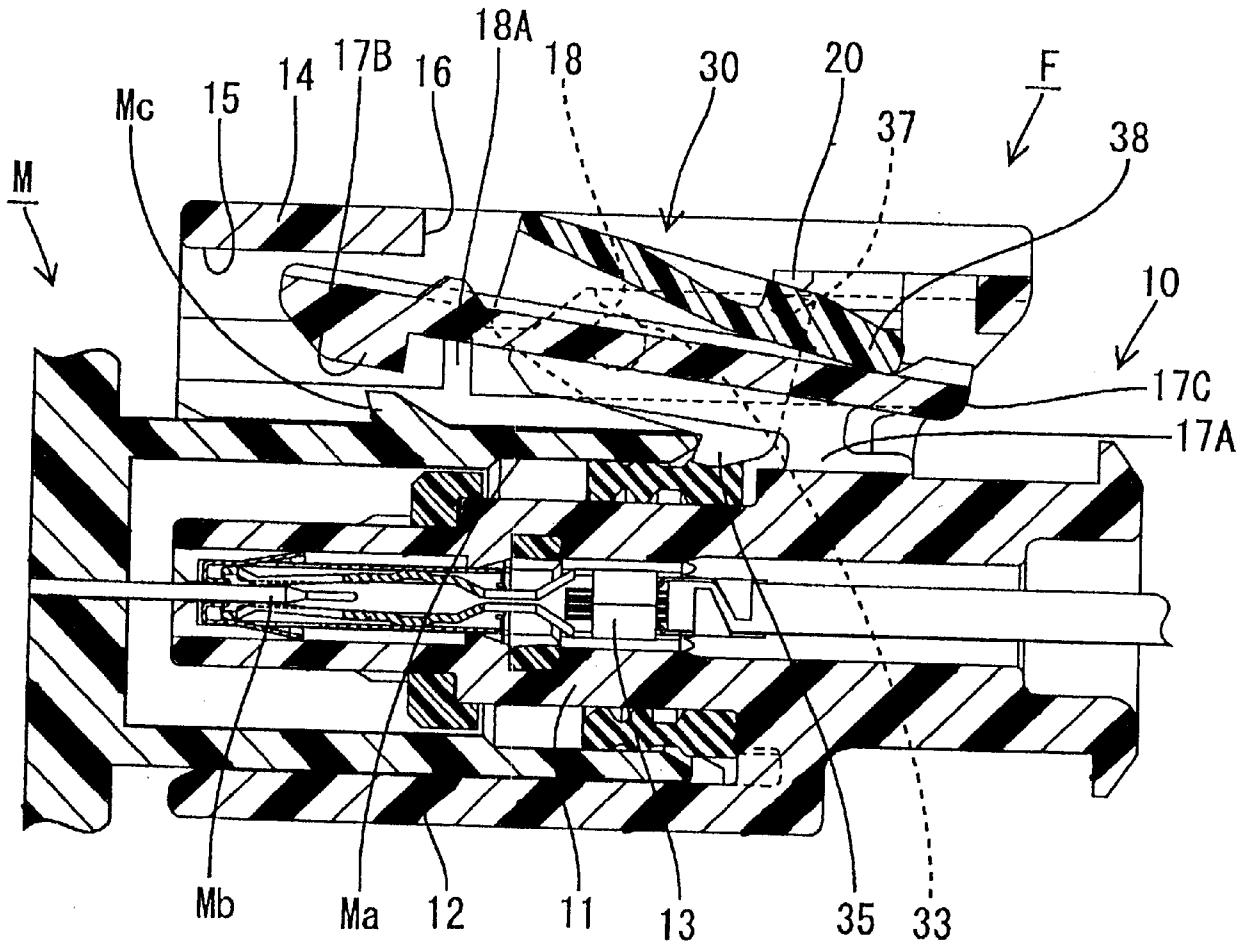
FIG. 12 is a section showing a state where the slider is inclined to an unlocking posture to disengage the lock arm from the receiving portion.

A lock arm 17 is formed at substantially the transverse center of the upper surface of the housing 10 and faces the operation space 15. A resiliently deflectable support 17A extends from the rear of the lock arm 17 to the upper surface of the housing main body 11 and enables front portions of the lock arm 17 to displace up and down or towards and away from the housing main body 11, as shown in FIG. 12. A locking projection 17B projects down at the front end of the lock arm 17 and can be engaged with the protuberance Mc to lock the female and male connectors F, M in their properly connected state. The lock arm 17 has an unlocking portion 17C that extends back from the support 17A. A trapezoidal pushable portion 17D is formed near the front end of the upper surface of the lock arm 17.

Guide grooves 18 are formed in the operation space 15 at the left and right side walls of the box 14 and extend in forward and backward directions along the inner surfaces. The guide grooves 18 are at substantially the same height as the lock arm 17 when the lock arm 17 is not deformed resiliently and have front stops 18A at their front ends. Backward movement restricting portions 20 are disposed above the guide grooves 18 and project inward at the rear ends of the left and right side walls. Further, substantially frustoconical spring receiving portions 21 project forward in the operation space 15 from left and right rear walls of the box 14 substantially at the same height as the guide grooves 18 and the lock arm 17 when the lock arm 17 is not deformed.

The connector 17 further includes a slider 30 with tubular left and right spring accommodating portions 31 that have a closed front end and an open rear end. A planar coupling 32 bridges the upper ends of the spring accommodating portions 31 such that upper surfaces of the spring accommodating portions 31 and the coupling 32 are substantially continuous and flush with each other. Round guide pins 33 project from the opposite outer side surfaces of the slider 30 and are accommodated loosely in the guide grooves 18. Thus, the slider 30 is accommodated in the operation space 15 and is movable parallel to the connecting and separating directions CSD. The outer diameter of the guide pins 33 is less than the width of guide grooves 18. Accordingly, vertical displacement of the slider 30 is permitted at any position within its movable range in forward and backward directions.

The slider 30 is accommodated in the operation space 15 and extends along the upper surface of the housing main body 11 and substantially surrounds the lock arm 17 from above. The spring accommodating portions 31 are at substantially opposite sides of the lock arm 17, and the coupling 32 is above the lock arm 17. Substantially front halves of the biasing springs 25 are disposed in the spring accommodating portions 31. Thus, the biasing springs 25 extend along the upper surface of the housing main body 11 and at opposite sides of the lock arm 17.

Loose movement of the slider 30 in directions that intersect the connecting and separating directions CSD is restricted by holding outer side surfaces of the spring accommodating portions 31 in contact with inner surfaces of the side walls of the box 14 and holding the inner side surfaces thereof in contact with the side surfaces of the lock arm 17.

Figure 6:
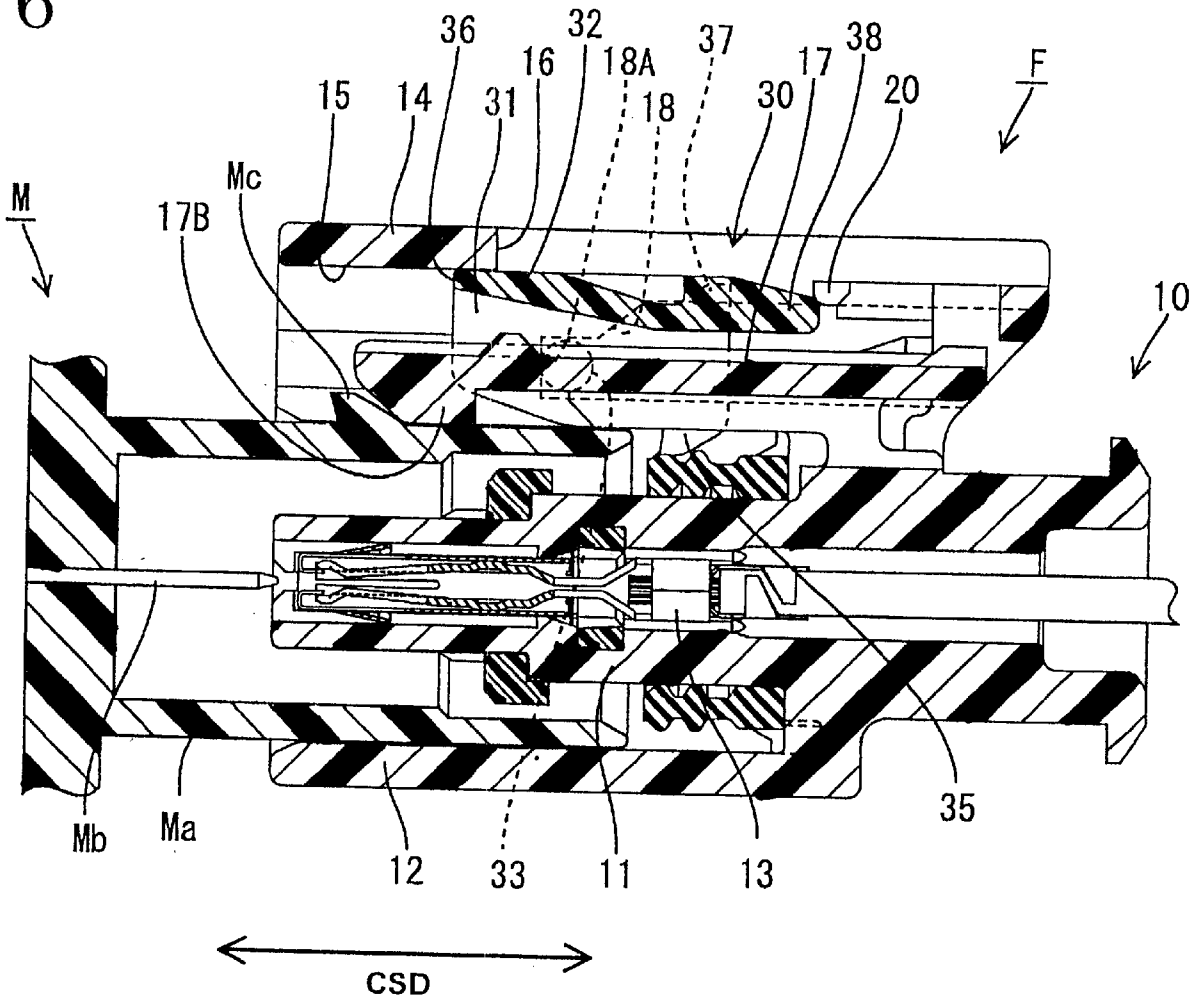
FIG. 6 is a section showing a state immediately after the start of connection of the connector with a mating connector.

Rear ends of the springs 25 in the spring accommodating portions 31 fit on the spring receiving portions 21. The resilient restoring forces of the springs 25 normally urge the slider 30 to a front position where the guide pins 33 contact the front-stop portions 18A of the guide grooves 18, as shown in FIG. 6. Accordingly, biasing forces are accumulated in the springs 25 as the slider 30 is moved back away from the mating connector M. The slider 30 held at this front end position is in its horizontal posture where the front end of the coupling 32 contacts the upper wall of the box 14 from below or inside.

Figure 9:
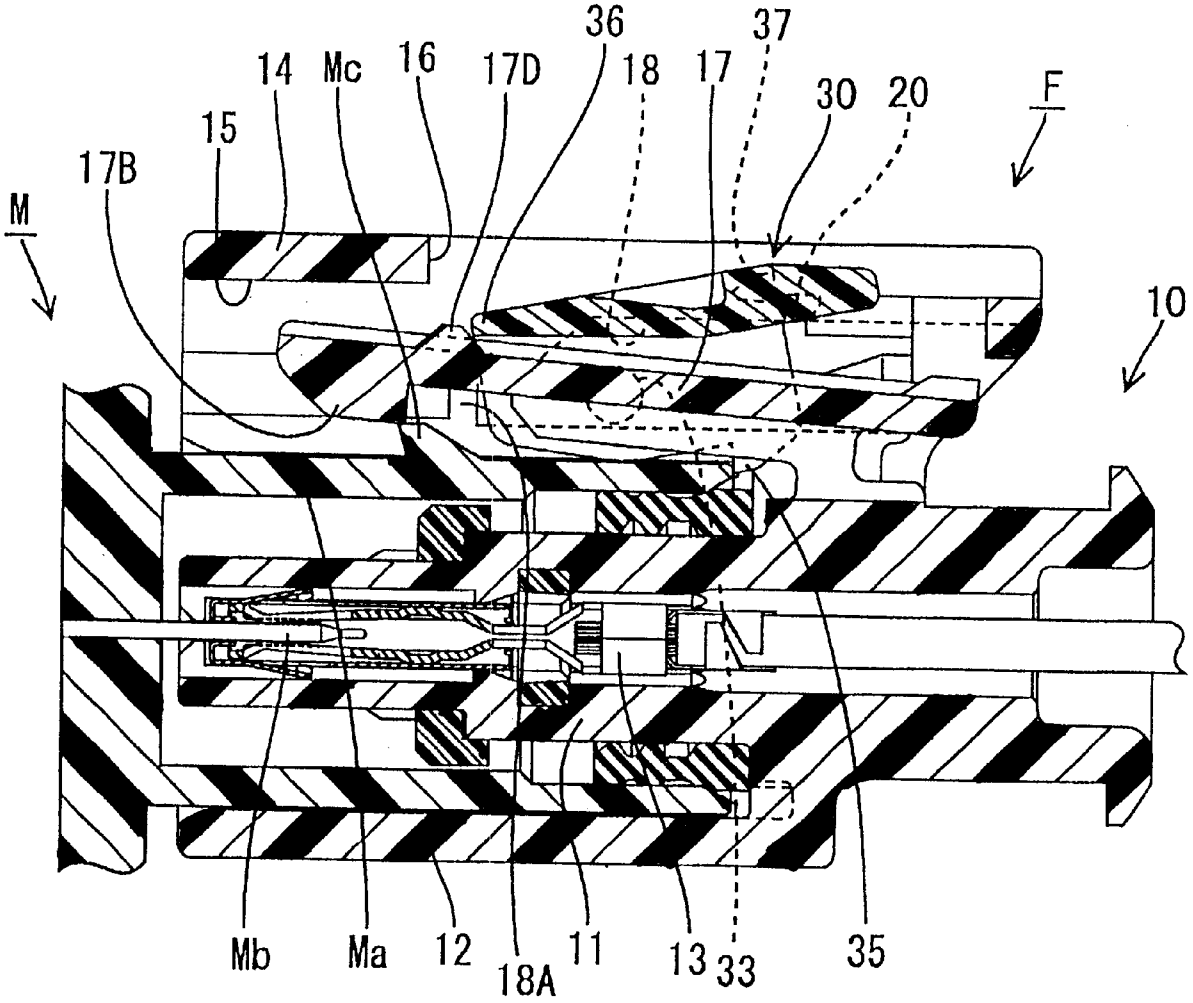
FIG. 9 is a section showing a state where a slider is inclined to contact the lock arm.

The slider 30 is displaceable to a forward-inclined posture or a backward-inclined posture at any position in its movable range while deforming the springs 25 such that their axes are curved. When the slider 30 is displaced to its forward-inclined posture, the rear end of the slider 30 enters the notch 16 of the box 14 to avoid interference with the box 14, as shown in FIG. 9.

The slider 30 is formed with left and right contacts 35 that project down from the bottom surfaces of the rear ends of the spring accommodating portions 31. The contacts 35 are at a height to contact the front end of the upper wall of the receptacle Ma when the slider 30 is in its horizontal posture. The left and right contacts 35 project down from the spring accommodating portions 31, extend along the upper surface of the housing main body 11 and are at opposite sides of the lock arm 17 similar to the spring accommodating portions 31 and the springs 25.

The front edge of the coupling 32 of the slider 30 defines a pusher 36. The pusher 36 contacts the pushable portion 17D of the lock arm 17 during a forward movement of the slider 30 with the slider 30 is disengaged from the receptacle Ma, with the connectors F, M properly connected and with the lock arm 17 displaced such its front end is moved up to disengage from the protuberance Mc. A forward pushing force of the slider 30 on the lock arm 17 pushes the lock arm 17 down due to the trapezoidal shape of the pushable portion 17D. Thus, the lock arm 17 is urged down and into engagement with the protuberance Mc.

The slider 30 is formed with restrictable portions 37 that project out from the rear ends of the outer side surfaces of the spring accommodating portions 31. The restrictable portions 37 are at substantially the same height in a direction substantially normal to the connecting and separating directions CSD as the backward movement restricting portions 20 of the box 14 when the slider 30 is in its horizontal posture. The restrictable portions 37 are more forward than the backward movement restricting portions 20 when the slider 30 is at its front position. The slider 30 also has a substantially plate-shaped unlocking portion 38 that extends back from the coupler 32. When the slider 30 is at its front position, the unlocking portion 38 is more forward than the unlocking portion 17C of the lock arm 17.

Figure 7:
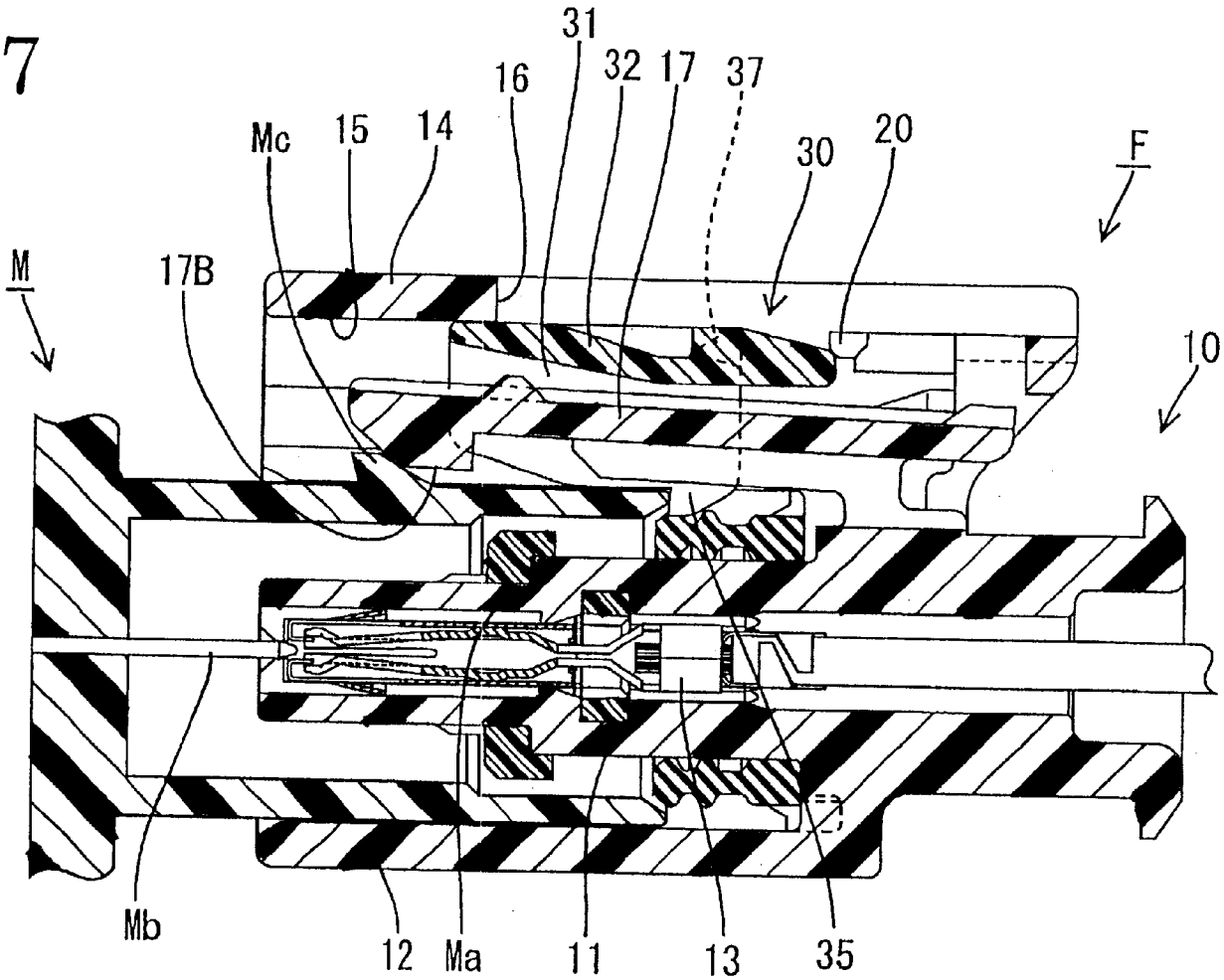
FIG. 7 is a section showing a state where a lock arm starts moving onto a receiving portion as connection with the mating connector proceeds.
Figure 8:
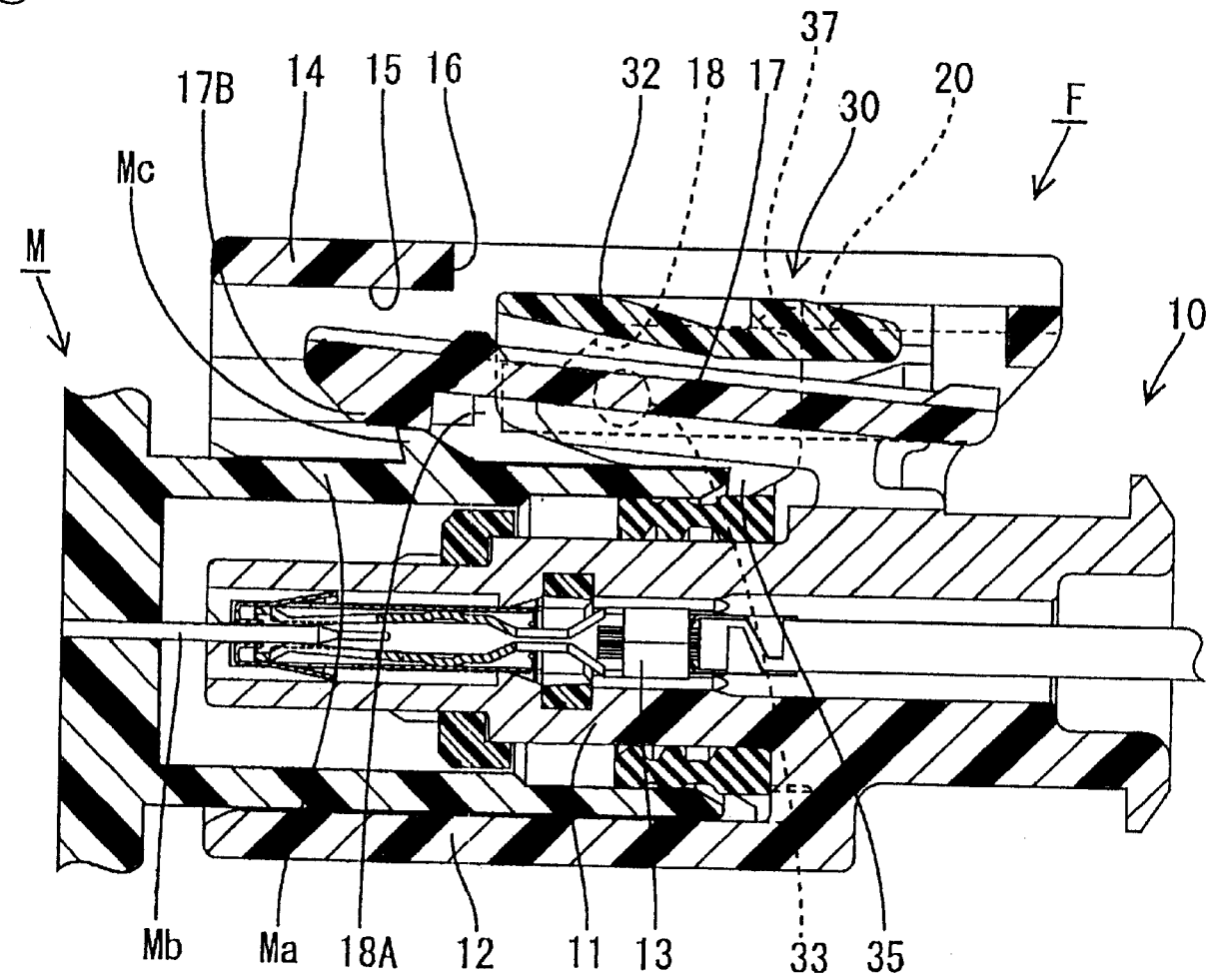
FIG. 8 is a section showing a state where the lock arm has moved onto the receiving portion.

The connector F is connected with the mating connector M by first fitting the housing main body 11 into the receptacle Ma and placing the tubular fitting 12 over the receptacle Ma. Thus, the locking projection 17B at the front end of the lock arm 17 contacts the protuberance Mc of the receptacle Ma, and the contacts 35 of the slider 30 approach the front end of the receptacle Ma, as shown in FIG. 6. As connection proceeds, the locking projection 17B starts moving onto the protuberance Mc and the contacts 35 engage the front of the receptacle Ma, as shown in FIG. 7. When connection proceeds further, the slider 30 is moved back with respect to the housing 10 against the resilient forces of the springs 25, and the springs 25 accumulate biasing forces. The locking projection 17B of the lock arm 17 then moves completely onto the protuberance Mc to deform the lock arm 17 to a maximum degree. The restrictable portions 37 of the slider 30 then contact the backward movement restricting portions 20 of the housing 10 from the front, as shown in FIG. 8, to prevent further rearward movement of the slider 30.

When connection proceeds further, the receptacle Ma pushes the contacts 35 at the bottom end of the slider 30 back, thereby pivoting the slider 30 forward about the guide pins 33, as shown in FIG. 9. As the slider 30 is inclined, the contacts 35 of the slider 30 are displaced up and disengage slightly from the receptacle Ma. As the connection of the connectors F, M and the inclining movement of the slider 30 proceeds, a contact area of the contacts 35 and the receptacle Ma decreases.

Figure 10:
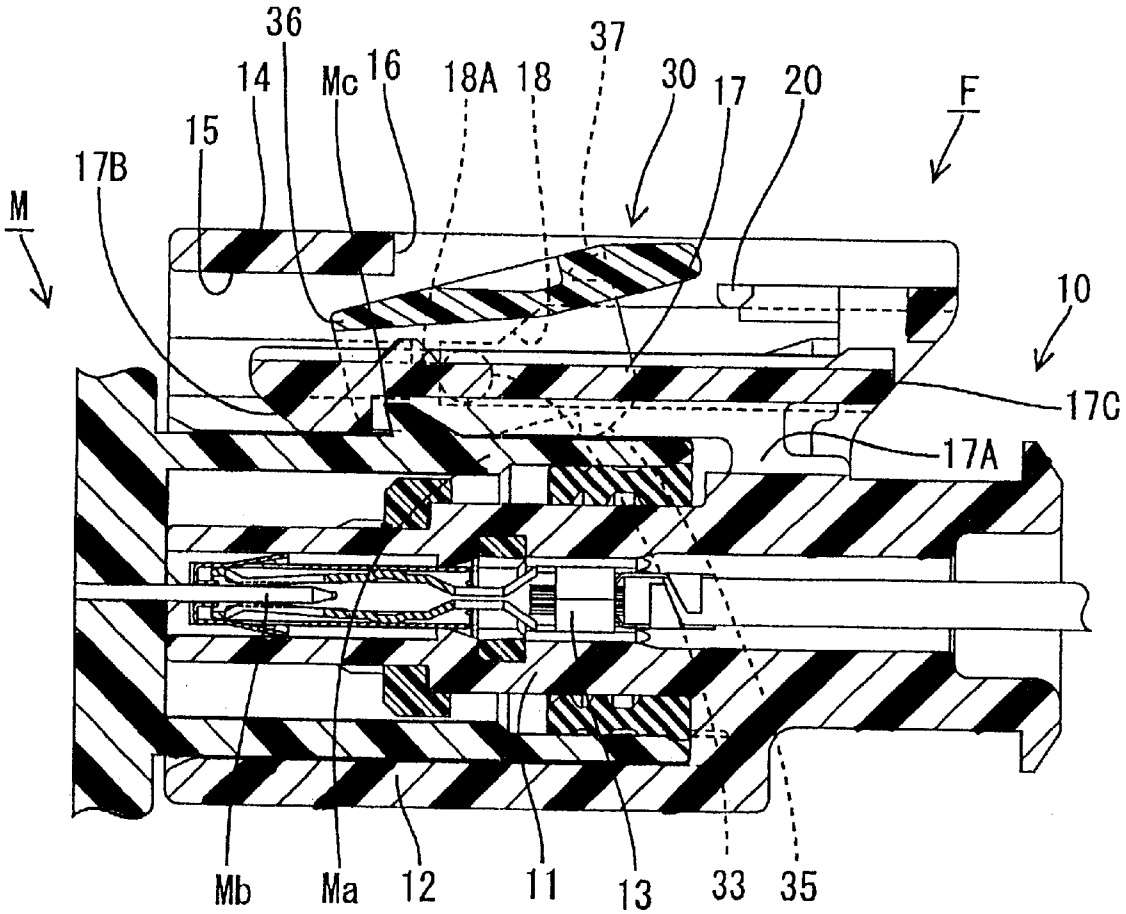
FIG. 10 is a section showing properly connected connectors.
Figure 11:
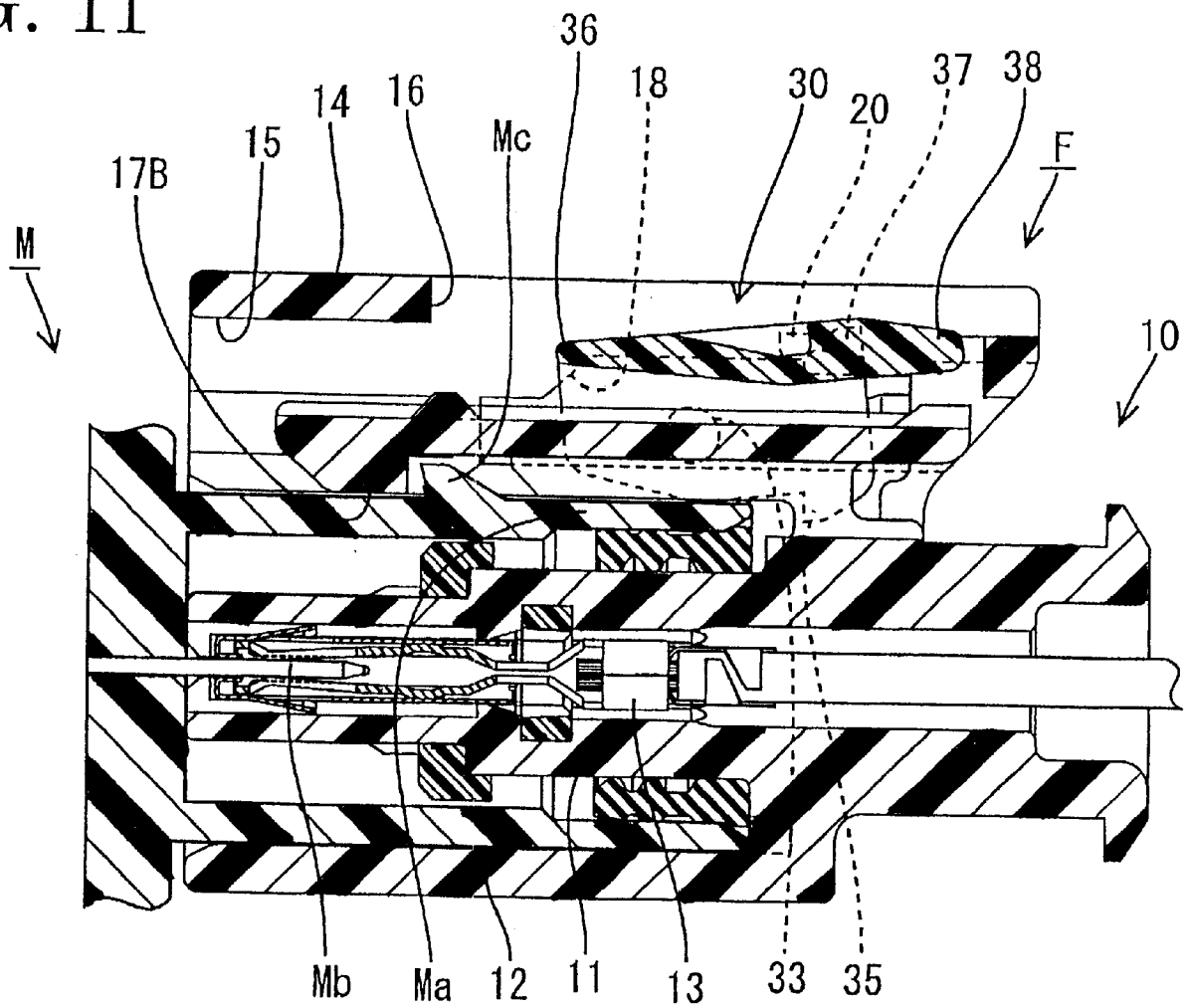
FIG. 11 is a section showing a state where the slider is moved backward in the properly connected state of the connectors.

The connectors F, M eventually reach a properly connected state, and the lock arm 17 is returned resiliently substantially to its horizontal posture. Thus, the locking projection 17B of the lock arm 17 passes and engages the protuberance Mc from behind as shown in FIG. 10, and the connectors F, M are locked together. The contacts 35 of the slider 30 disengage upwardly from the front end of the receptacle Ma when the connectors F, M are connected properly with each other. The resilient restoring forces of the springs 25 then move the slider 30 forward and the contacts 35 slide over the upper surface of the receptacle Ma while the slider 30 is held in the forward inclined posture. As a result, the slider 30 returns to the front end position where the guide pins 33 contact the front-stops 18A of the guide grooves 18 (see FIG. 10).

Immediately before the two connectors F, M are connected properly, the pusher 36 of the slider 30 is subjected to the resilient forces of the springs 25, and, as shown in FIG. 9, the pusher 36 pushes the pushable portion 17D of the lock arm 17 that has been disengaged from the protuberance Mc. Accordingly, the lock arm 17 is displaced down toward the protuberance Mc by the pushing force from the slider 30 even if the lock arm 17 cannot be returned by its own resilient restoring force to its horizontal posture where it is engaged with the protuberance Mc when the two connectors F, M are connected properly.

In a partially connected state shown in FIGS. 6–9, the slider 30 contacts the receptacle Ma and is moved back while accumulating the biasing forces in the springs 25. If a connecting operation is interrupted in this partially connected state, the slider 30 pushes the receptacle Ma back while being moved forward by the biasing forces accumulated in the springs 25, thereby forcibly separating the connectors F, M from each other. This forcible separation shows that the connectors F, M were left partly connected without reaching the properly connected state.

The two connectors F, M can be separated from the properly connected state by first sliding the slider 30 back in its forward inclined posture while accumulating biasing forces in the springs 25. Sufficient backward movement causes the restrictable portions 37 of the slider 30 to contact the backward movement restricting portions 20 of the housing 10, thereby causing the restrictable portions 37 of the forwardly inclined slider 30 to move over the backward movement restricting portions 20. After the restrictable portions 37 move over the backward movement restricting portions 20, the slider 30 is inclined into a substantially horizontal posture where the lock arm 17 can engage the protuberance Mc, and where the restrictable portions 37 are behind the backward movement restricting portions 20 (see FIG. 11).

In this state, the unlocking portion 38 at the rear end of the slider 30 is pushed down without moving the slider 30 forward, thereby inclining the slider 30 backward about the guide pins 33 and into an unlocking posture. The unlocking portion 38 pushes the unlocking portion 17C at the rear end of the lock arm 17 when the slider 30 is displaced to the unlocking posture. Thus, the lock arm 17 is displaced to the unlocking posture where the locking projection 17B thereof is disengaged upward from the protbereance Mc (FIG. 12).

Figure 4:
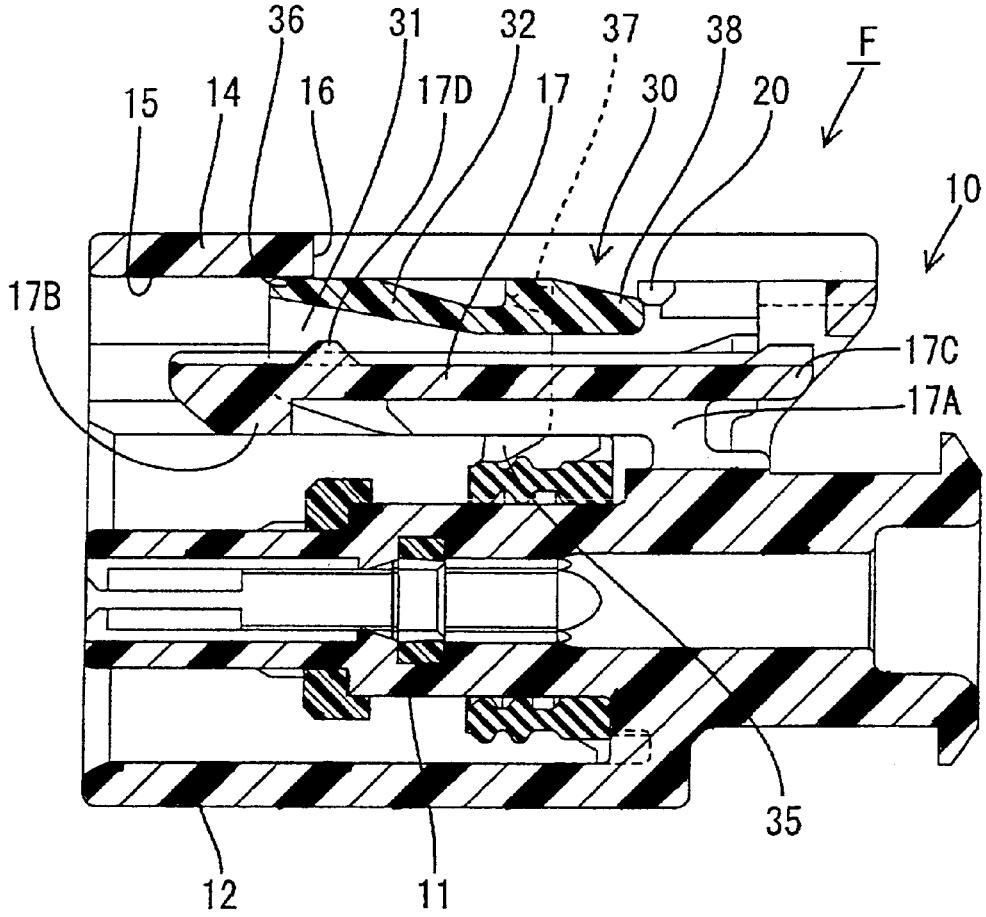
FIG. 4 is a section of the connector.
Figure 5:
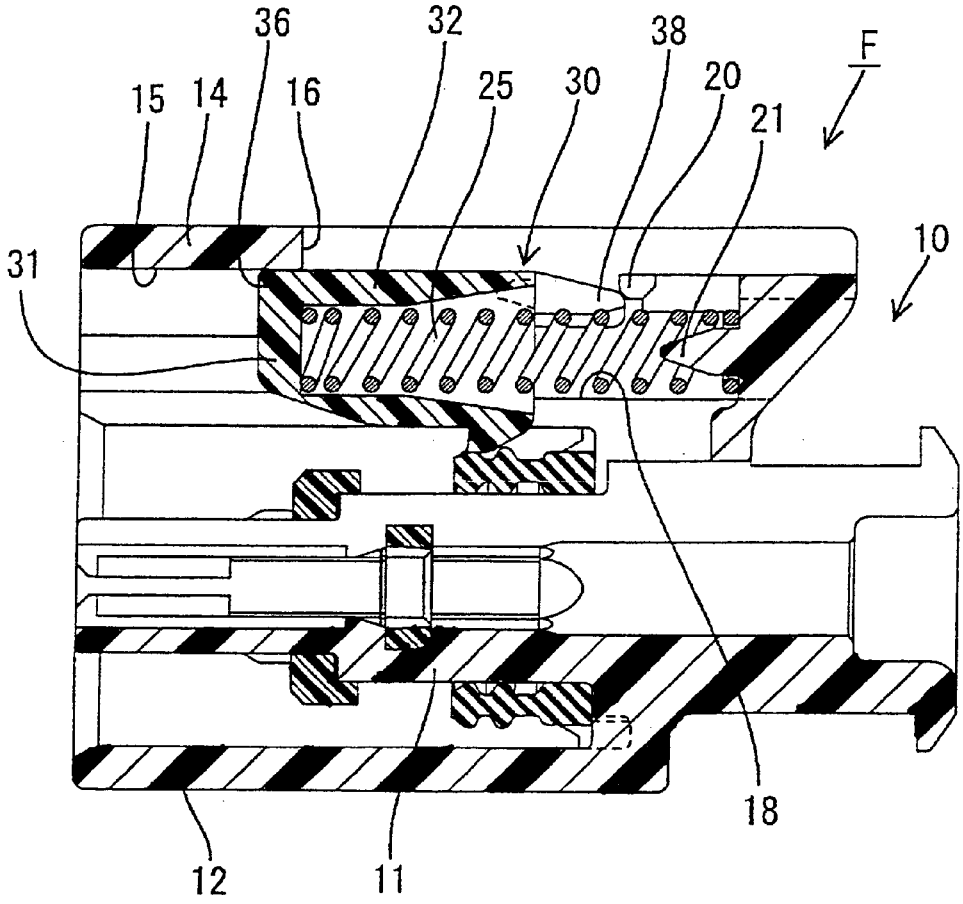
FIG. 5 is a section of the connector.

The two connectors F, M then are pulled apart in this unlocked state, and the slider 30 is returned resiliently to its horizontal posture and to its front end position. The lock arm 17 then resiliently returns to its horizontal posture as shown in FIGS. 4 and 5 if the slider 30 is let to go.

The contacts 35 of the slider 30 are displaced down to contact the front end of the receptacle Ma when the slider 30 is displaced to the unlocking posture. The biasing forces accumulated in the springs 25 are given to the receptacle Ma via the slider 30 and the restrictable portions 37 are displaced down below the backward movement restricting portions 20, thereby permitting the forward movement of the slider 30 (see FIG. 12). Accordingly, if a separating operation is interrupted in this state, the slider 30 is moved forward by the biasing forces accumulated in the springs 25 while pushing the receptacle Ma back and forcibly separating the two connectors F, M. This forcible separation shows that the separating operation was interrupted with the connectors F, M left partly connected.

As described above, left and right springs 25 and left and right contacts 35 of the slider 30 are at opposite sides of the lock arm 17 along the upper surface of the housing 10. Thus, the housing 10 is narrower than a conventional connector that has the springs and the contacts of the slider on the left and right side surfaces of the housing.

Further, the slider 30 is inclinable and disengageable from the receptacle Ma and is movable forward toward the mating connector M by the biasing forces of the springs 25. When the two connectors F, M are connected properly, the biasing forces accumulated in the springs 25 are released. Thus, the springs 25 do not experience a resilient strain or fatigue or wear-out even if the connectors are held properly connected for a long time.

The slider 30 has the pusher 36 and the lock arm 17 has the pushable portion 17D. With this construction, the slider 30 pushes the lock arm 17 to engage the protuberance Mc while being moved forward even if the lock arm 17 is left disengaged from the protuberance Mc with the connectors F, M properly connected. Thus, locking by the lock arm 17 and the protuberance Mc functions securely.

Further, locking by the lock arm 17 and the protuberance Mc is canceled if the rearwardly disposed slider 30 is inclined to the unlocking posture to separate the connectors F, M from each other. Thus, it possible to separate the connector F from the mating connector M and the contacts 35 of the slider 30 engage the receptacle Ma to give the biasing forces of the springs 25 to the receptacle Ma, thereby enabling a partial connection detection. In other words, separation from the mating connector M and partial connection detection both can be achieved merely by making one action of inclining the slider 30. Therefore, operability during the separating operation is good.

The present invention is not limited to the above described and illustrated embodiment. For example, following embodiments are also embraced by the technical scope of the present invention as defined in the claims. Beside the following embodiments, various changes can be made without departing from the scope and spirit of the present invention as defined in the claims.

Although the contacts of the slider are brought into contact with the front end surface of the receptacle in the foregoing embodiment, they may be brought into contact with projections on the outer surface of the receptacle.

The contacts are at the rear end of the slider in the illustrated embodiment. However, they may be at a front or middle position of the slider.

The slider is returned forward by the springs with the connector properly connected with the mating connector in the foregoing embodiment. However, the slider may be moved back so that the springs keep accumulated biasing forces in the properly connected state of the connectors.

What is claimed is:

1. A connector connectable with and separable from a mating connector, the mating connector having a receptacle projecting forward and a protuberance formed on the receptacle, the connector comprising:

a housing having a front end fittable into the receptacle, and a backward movement restricting portion disposed rearwardly of the front end, a lock arm on the housing and adapted to hold a properly connected state of the connector with the mating connector by being engaged with the protuberance when the connector is properly connected with the mating connector, a pushable portion formed on the lock arm, a slider in the housing and movable forward and backward substantially parallel to connecting and separating directions of the connector and the mating connector, the slider having left and right contacts disposed on opposite respective side of the lock arm and having a restrictable portion for contacting the backward movement restricting portion of the housing during connection of the connector with the mating connector, the slider being inclinable with respect to the housing in a direction for disengaging the contacts of the slider from the receptacle when the connectors reach a properly connected state, the slider further having a pusher for contacting the pushable portion of the lock arm during a forward movement of the slider, left and right springs engaging the left and right contacts of the slider for biasing the slider forward, and the slider contacting the receptacle and being moved backward while accumulating biasing forces in the biasing means at intermediate stages of the connection and separation of the connector with and from the mating connector, wherein the slider is moved forward by the biasing forces of the springs when the properly connected state of the connector is reached so that the contact is slid over a surface of a receptacle and wherein the pusher of the slider contacts the pushable portion of the lock arm while the slider is moving forward with the connector properly connected with the mating connector and the lock arm displaced to a posture disengage from the protuberance.

2. The connector of claim 1, wherein the slider is held laterally by a box formed on the connector and wherein the slider engages lateral surfaces of the lock arm.

3. The connector of claim 1, wherein the slider is arrangeable in a horizontal position, wherein at least one contact portion thereof is at a height to contact a front end of the receptacle when the slider is in the horizontal position.

4. The connector of claim 1, wherein when the slider is in an inclined position an end thereof projects into a notch in the housing.

5. A connector connectable with and separable from a mating connector, the mating connector having a receptacle projecting forward and a protuberance formed on the receptacle, the connector comprising:

a housing fittable into the receptacle, a lock arm on the housing and adapted to hold a properly connected state of the connector with the mating connector by being engaged with the protuberance when the connector is properly connected with the mating connector, a slider in the housing and movable forward and backward substantially Parallel to connecting and separating directions of the connector and the mating connector, biasing means for biasing the slider forward, and the slider contacting the receptacle and being moved backward while accumulating biasing forces in the biasing means at intermediate stages of the connection and separation of the connector with and from the mating connector wherein the slider is inclinable between a lock permitting posture where the slider permits engagement of the lock arm with the protuberance and an unlocking posture where the slider displaces the lock arm in a direction to be disengaged from the protuberance when the slider is at a moved-back position.

6. The connector of claim 5, wherein the contact of the slider is in contact with the receptacle and the biasing forces accumulated in the biasing means are given to the receptacle via the slider when the slider is inclined to the unlocking posture.

* * * * *